US006418981B1

(12) United States Patent
Nitecki et al.

(10) Patent No.: US 6,418,981 B1
(45) Date of Patent: Jul. 16, 2002

(54) METHOD OF CHECKING THAT A SYSTEM FOR RECOVERING VAPOUR EMITTED IN A FUEL DISPENSING INSTALLATION IS OPERATING CORRECTLY AND INSTALLATION ENABLING SAID METHOD TO BE IMPLEMENTED

(75) Inventors: Jean-Pierre Nitecki, Buc; Jacques Fournier, Bretigny sur Orge, both of (FR)

(73) Assignee: Tokheim Services France, Le Plessis Robinson (FR)

( * ) Notice: Subject to any disclaimer, the term of this patent is extended or adjusted under 35 U.S.C. 154(b) by 0 days.

(21) Appl. No.: 09/618,436

(22) Filed: Jul. 18, 2000

(51) Int. Cl.[7] ..... B65B 31/00; B67C 3/00

(52) U.S. Cl. ..... 141/4; 141/59; 141/83; 141/94; 141/196; 141/290

(58) Field of Search ..... 141/4, 45, 47, 141/59, 94, 186, 192, 196, 285, 290, 302, 83; 73/23.2, 31.02, 40.5 R

(56) References Cited

U.S. PATENT DOCUMENTS 5,507,325 A * 4/1996 Finlayson ..... 141/83
5,850,857 A 12/1998 Simpson ..... 141/59
5,860,457 A * 1/1999 Andersson ..... 141/59
5,913,343 A 6/1999 Anderson ..... 141/59
6,109,311 A * 8/2000 Fournier et al. ..... 141/59

FOREIGN PATENT DOCUMENTS

| | | |
|---|---|---|
| EP | 653376 | 5/1995 |
| WO | WO 93/10036 | 5/1993 |
| WO | WO 97/43204 | 11/1997 |

* cited by examiner

*Primary Examiner*—Timothy L. Maust
(74) *Attorney, Agent, or Firm*—Drinker Biddle & Reath LLP

(57) ABSTRACT

A dispensing installation for fuel or other volatile liquids comprises a storage tank, a pipe and a pump for dispensing fuel, a vapor recovery pipe and pump for recovering vapor and delivering it back to the tank, and a controller maintaining the vapor delivery rate approximately equal to the liquid delivery rate. In order to check that the vapor recovery system is operating correctly, the vapor delivery rate is constantly detected and compared with a value of the liquid delivery rate. If the result of the comparison is outside a predetermined range, an alarm is triggered in order to indicate a malfunction. The predetermined range may be adjustable.

21 Claims, 6 Drawing Sheets

METHOD OF CHECKING THAT A SYSTEM FOR RECOVERING VAPOUR EMITTED IN A FUEL DISPENSING INSTALLATION IS OPERATING CORRECTLY AND INSTALLATION ENABLING SAID METHOD TO BE IMPLEMENTED

FIELD OF THE INVENTION

The present invention relates to a method of checking that a system recovering vapour emitted in a liquid dispensing installation, in particular when dispensing fuel to the interior of a motor vehicle tank, is operating correctly.

BACKGROUND OF THE INVENTION

Fuel dispensing installations conventionally comprise a fuel storage tank, a pipe for dispensing liquid incorporating a delivery pump enabling the fuel to be circulated between the storage tank and a dispensing gun at a liquid delivery rate QL, as well as counting means connected into the liquid dispensing pipe and fitted with a liquid measuring unit linked to a pulse generator or coder enabling a computer to ascertain the volume and price of the fuel dispensed, which then appear in plain text on a display.

For reasons of safety (risk of explosion) and environmental protection, installations of this type ate generally fitted with a system for recovering vapour emitted when the tank is being filled; such a system comprises a pipe for recovering vapour incorporating a recovery pump which enables the vapour to be circulated between the dispenser gun and the storage tank at a vapour delivery rate QV when the tank is being filled.

In order for a system of this type to operate efficiently, the delivery rate of the vapour QV at any instant must be approximately the same as the liquid delivery rate QL.

In order to achieve this performance, the recovery system is fitted with control means which are able to maintain this balance.

In smaller installations having only one or two dispenser guns, these control means are provided in the form of simple means whereby the vapour delivery rate QV is calibrated beforehand on the maximum liquid delivery rate QLmax, which is generally in the order of 40 litres per minute.

In larger, more sophisticated installations, the control teams consist of an electronic control unit fitted with a microprocessor, connected to counting means which supply the value of the liquid delivery rate QL instantaneously and co-operate either with the recovery pump if it is of the variable delivery type and hence operates a variable delivery rate, or with an electronically operated control valve connected into the vapour recovery pipe if the recovery pump operates at a fixed rate. In a system of this type, the values governing opening of the electronically operated control valve or the speed of the recovery pump corresponding to a vapour delivery rate QV are stored in the memory of the microprocessor during the initial calibration process.

Vapour recovery system of the type outlined above are generally efficient immediately after they have been calibrated. After a period in service operation, however, the results become leas certain, not to say totally erratic.

This situation is generally attributable to ageing of the equipment: wear on the pumps, clogged pipelines, stretching in the belts leading to a reduction in pumping rates, blocked pumps, etc.

Currently used installations are not fitted with units to detect when operation is poor and incapable of maintaining equality between the liquid delivery rate QL and the vapour delivery rate QV and the period between two service inspections on the installation may be very long (one to three years), which represents a source of pollution in particular and is therefore harmful to the air quality.

It should be pointed out that an earlier document, U.S. Pat. No. 5,332,008, discloses (column 4, lines 13–18) a fuel dispensing installation incorporating a vapour recovery system which is fitted with a sensor detecting operation of the recovery pump, which means that the speed normally expected of this pump can be checked and distribution disabled in the event of an anomaly.

However, this detection system is not always able to react if the pump is exhibiting mechanical wear (changes in its characteristics), which may render it incapable of attaining a vapour delivery rate QV equal to the liquid delivery rate QL.

The same applies if the suction or delivery pipes of the recovery pump become partially or totally blocked (due to encrustation or by accidental means); if an installation is fitted with an electronically operated control valve, its timing will initially have been programmed after calibration, thereby preventing an adequate delivery rate from being achieved and the vapour delivery rate QV is always lower than the liquid delivery rate QL and may even fall to zero under extreme circumstances unless the detection system disclosed in this earlier publication triggers an alarm to indicate that there is a malfunction.

In document U.S. Pat. No. 5,857,500, it was also suggested that automatic checks be made on the recovery pump for wear, when not dispensing fuel, by means of a command issued to electronically controlled valves upstream and downstream of the pump to be checked and to do so by providing two pressure sensors to measure the active or negative pressures attained when the pump is rotating. The pressures measured during an opening/closing cycle of the electronically controlled valves can be compared with the measurements taken when the system was installed in order to determine the extent of wear on the recovery pump.

According to this earlier document, another test was to measure the drop in pressure on the auction side what dispensing In order to evaluate the degree of encrustation or blockage at the level of the vapour recovery pipe.

However, these are nothing more than pressure measurements which depend both on an instantaneous delivery rate and resistance in the line in which changes are evaluated as compared with the initial situation as recorded on the date of installation.

SUMMARY OF THE INVENTION

The objective of the present invention in to remedy the above-mentioned disadvantages by proposing a method of checking that the system used to recover vapour in a liquid dispensing installation, in particular when dispensing fuel to the interior of a motor vehicle tank, is operating correctly, providing a reliable indication of any malfunction in the vapour recovery system, regardless of the source of this malfunction Accordingly, the method proposed by the invention is characterised in that:

- the vapour delivery rate QV is constantly detected by detection means,
- the value of the vapour delivery rate QV thus detected is transmitted to comparison means which compare it with a value of the liquid delivery rate QL and if the result of this comparison is outside a predetermined range, which may or may not be adjustable, an alarm is triggered in order to indicate a malfunction.

In a first embodiment of the invention adapted to a vapour recovery systen having an electronic control unit co-operating with an electronically operated control valve or a variable delivery pump, the value of the liquid delivery rate QL determined by the counting means is constantly transmitted to the comparison means and it is compared with the value of the vapour delivery rate QV detected by the detection means.

It should be pointed out that in the case of this embodiment, the vapour delivery rate QV is compared with the liquid delivery race QL by the electronic control unit if this function has been programmed in the microprocessor incorporated therein, although this is not always the case with existing systems which would have to be modified accordingly.

In addition, if the microprocessor of the electronic control unit is able to interact with the computer of the counting means, the alarm could also be transmitted via this computer to the service station manager or remotely transmitted to a maintenance company which could then respond more rapidly.

In a second embodiment of the invention adapted to a simplified recovery system which does not have an electronic control unit and in which the control means correspond co a prior calibration of the vapour delivery rate QV to the maximum liquid delivery rate QLmax, the maximum value QLmax of the liquid delivery rate QL in stored in the comparison means and the value of the vapour delivery rate QV detested by the detection means in compared with this maximum value QLmax, With regard to this second embodiment, it should be pointed out that the threshold triggering the alarm indicating a malfunction may be based on a specific mechanical structure or alternatively on a fluid-related phenomenon.

By virtue of another feature of the invention, also relating to this second embodiment, the alarm indicating a malfunction is disabled for a predetermined period after the liquid dispensing pump has been activated and it is then re-activated for a predetermined time so that it can be disabled again until the end of the tank-filling operation.

It is often necessary to disable the system in this manner, particularly at the end of the filling protest when the user finishes the operation at a low delivery rate or alternatively at the start of filling: accordingly, the invention enables the alarm to be disabled for a time to after detecting the first pulses indicating the start of liquid delivery QL, after which the alarm may be active for a time ti and finally disabled again after t0+t1 until the end of filling, which is of particular advantage in the case of pre-payment.

It should be pointed out that the fuel dispensing system can be fitted with an additional device such as a calibrated detector (for example a detector with paddles or vanes which move with the liquid flow QL) co-operating with an alarm switch which allows the alarm to be disabled if the liquid delivery rate QL is below the maximum liquid delivery rate QLmax.

As a result of a preferred feature of the invention, the detection means and the comparison means are selected so that any fault in these means will also trigger the alarm to indicate a malfunction.

This essential characteristic, which corresponds to an active safety system, allows the alarm to be triggered to indicate a malfunction irrespective of the source of this malfunction.

It should be pointed out that a delivery rate measurement based on measuring a pressure difference at the terminals of a membrane by means of a pressure sensor susceptible to drift, can nor be regarded as an active safety system of the type mentioned above whereas a detector, on the other hand, transmitting an alternating signal depending on the flow rate will almost always be seen as an active safety feature.

The invention also relates to an installation enabling the above-mentioned method to be implemented.

For the purpose of the invention, such an installation conventionally comprises:

a storage tank for the fuel to be dispensed, a dispensing pipe for the liquid incorporating a delivery pump which enables the fuel to be circulated between the storage tank and a dispenser gun at a liquid delivery rate QL, a vapour recovery pipe incorporating a recovery pump enabling the vapour emitted when filling the tank to be circulated between the dispenser gun and the storage tank at a vapour delivery rate QV, counting means connected into the liquid dispensing pipe and having a liquid measuring unit linked to a pulse generator or coder so that a computer can ascertain the volume and price of the fuel dispensed, which will appear in plain text on a display and control means enabling the vapour delivery rate QV to be held more or less at the same level as the liquid delivery rate QL at any instant.

For the purpose of the invention, this installation is characterised in that it comprises.

detection means enabling the vapour delivery rate QV to be constantly detected, comparison means sensitive to the vapour delivery rate QV detected by the detection means and enabling this delivery rate QV to be compared with a value of the liquid delivery rate QL and alarm means which, if the result of this comparison is outside a predetermined range, which may be or not be controllable, triggers an alarm alerting either to a fault in the vapour recovery system, in particular the control means, or a failure of the detection means or comparison means.

In accordance with the invention, the signal transmitted by the alarm means may be an optical signal or an electric signal emitted, as is the case, by a detector mounted on the tracker of a magnetic member.

It should be pointed out that the alarm may be given simply by interrupting the delivery of fuel.

The configuration of the detection means and the comparison means may vary to a large degree depending on the characteristics of the fuel dispensing installation and in particular depending on whether it is adapted to the first or second of the embodiments mentioned above.

By way of example and in accordance with another feature of the invention the detection means may be a flow detector of the fluid oscillator type such as a flow meter with an oscillating jet or an eddy flow meter.

In flow meters of this type, the alternating passage of the vapour jet in front of two orifices connected to a differential pressure sensor, for example, generates an alternating pressure detected by the sensor and amplified; only the frequency of the phenomenon is taken into account not its amplitude, which is susceptible to shifts in the pressure sensor. The frequency F of the signal emitted by the amplifier is directly proportional to the vapour flow rate; this frequency F compared with a pre-established reference frequency FO enables an alarm to be triggered, for example as soon as $1.1 \leqq F/F0 \leqq 0.9$.

If the vapour recovery system in managed by a microprocessor, this comparison operation is easy and can be set up without any additional expense.

An operating fault in the sensor or the amplifier or any damage at the orifices at which the differential pressure measurement is taken correspond to an absence of any signal and hence to a zero flow rate. Consequently, any malfunction in a detection system of this type will cause an alarm to be triggered and is therefore also an active safety feature.

By virtue of another feature of the invention, the detection means are provided in the form of a mechanical oscillator.

A flow detector based on the movement of a mechanical oscillator whose frequency depends on the flow rate can also be regarded as an active safety system for the same reasons as those described above.

In accordance with another characteristic of the invention, the detection means are provided in the form of a constrictive element, in particular of the Venturi type, connected to a system that is sensitive to pressure and provided with a mechanical memory.

In accordance with another feature of the invention, the detection means ray be a constrictive member, in particular of the venturi type, which do not operate except above a f low threshold which may or tray not be adjustable.

In accordance with another feature of the invention, the detection means are a turbine.

A turbine gives accurate information about flow rate and above all enables an alternating signal to be generated, for example as its vanes pass in front of a detector (optical, field-effect, etc.), and is therefore an active safety feature.

Any slowing down due to untimely friction or blockage of the turbine triggers an alarm. Clearly, reliable usage of a turbine would only be conceivable if dust had been totally removed from the gases.

By virtue of another feature of the invention, the detection means are provided in the form of a paddle or obstacle.

In accordance with another feature of the invention, the detection means co-operate with alarm means via optical transmission units.

BRIEF DESCRIPTION OF THE FIGURES

The characteristics of the method and the installation proposed by the invention will be described in more detail with reference to the appended drawings, in which.

DETAILED DESCRIPTION OF THE INVENTION

Figure 1:
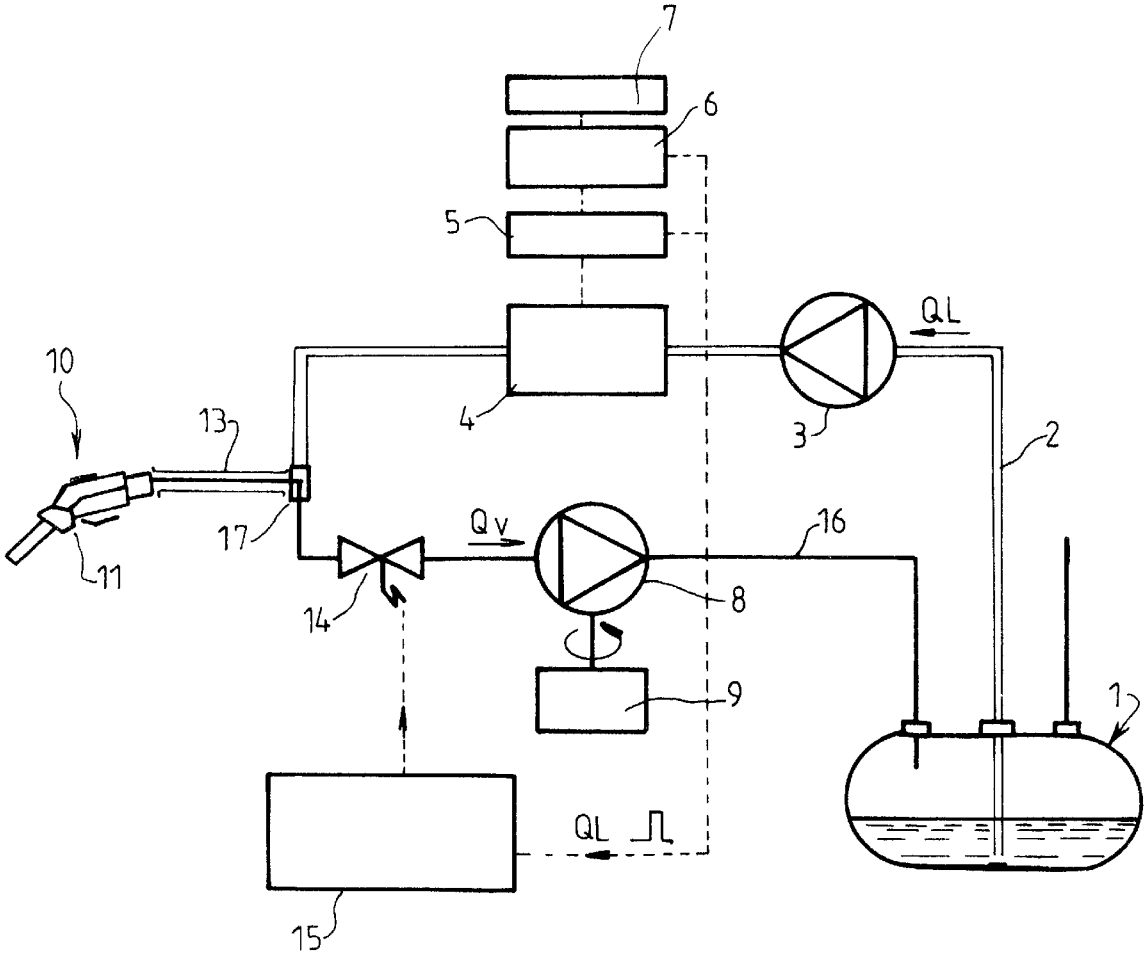
FIG. 1 shows a fuel dispensing installation incorporating a vapour recovery system fitted with an electronic control unit of the type used in the prior art.

As illustrated in FIG. 1, the fuel dispensing installation essentially comprises a storage tank 1 for the fuel to be dispensed in Which a liquid dispensing pipe 2 is immersed enabling the fuel to be circulated to a dispenser gun 10 by means of a suction/pressure delivery pump 3 And to be so at a liquid delivery rate QL, as well as a vapour recovery pipe 16 comprising a suction/pressure recovery pump 8 enabling the vapour emitted when filling the tank to be circulated between the dispenser gun 10 and the storage tank and to be so at a vapour delivery rate QV.

The volume of fuel dispensed is determined by means of a liquid measuring unit 4, connected into the dispensing pipe 2 and linked to a pulse coder 5 which emits a pulse with every one hundredth of a litre. These pulses are counted by a computer 6 in order to determine the volume dispensed and the corresponding price so that this information can be transmitted to the consumer on a display 7.

The gun 10 on the one hand dispenses the liquid fuel from its end-piece 12 and on the other recovers the vapour emitted during filling by means of a suction inlet 11.

To this end, it is mounted at the end of a coaxial pipe 1, in which the fuel is conveyed through an annular section whilst the vapour are sucked in via the circular section at the centre.

This coaxial pipe 13 connects directly into the liquid dispensing pipe 2 whilst a separator 17 enables the vapour to be fed in the direction of the tank 1 via the vapour recovery pipe 16.

In the example illustrated in FIG. 1, the recovery pump 8 is a fixed speed pump driven by a motor 9 co-operating with an electronically operated control valve 14, the opening of which is controlled by an electronic control unit 15 fitted with a microprocessor, so as to maintain the vapour delivery rate QV equal to the liquid delivery rate QL at any instant: to this end, the electronic control unit 15 is corrected to the pulse coder 5 or to the computer 6, so as to be supplied with the instantaneous value of the liquid delivery rate QL. This value may be transmitted either directly by the computer 6 or in the form of a number of pulses per unit of time by the pulse coder 5 then computed by the electronic control unit 15.

In all cases, the value controlling opening of the electronically operated valve 14 which enables the delivery rates QL and QV to be kept equal is determined on the basis of a table stored in the microprocessor memory of the electronic control unit 15 beforehand, during a calibration process, in order to take account of the installation conditions (drops in pressure) and the actual performance of the recovery pump 8 at the time of installation.

Figure 2:
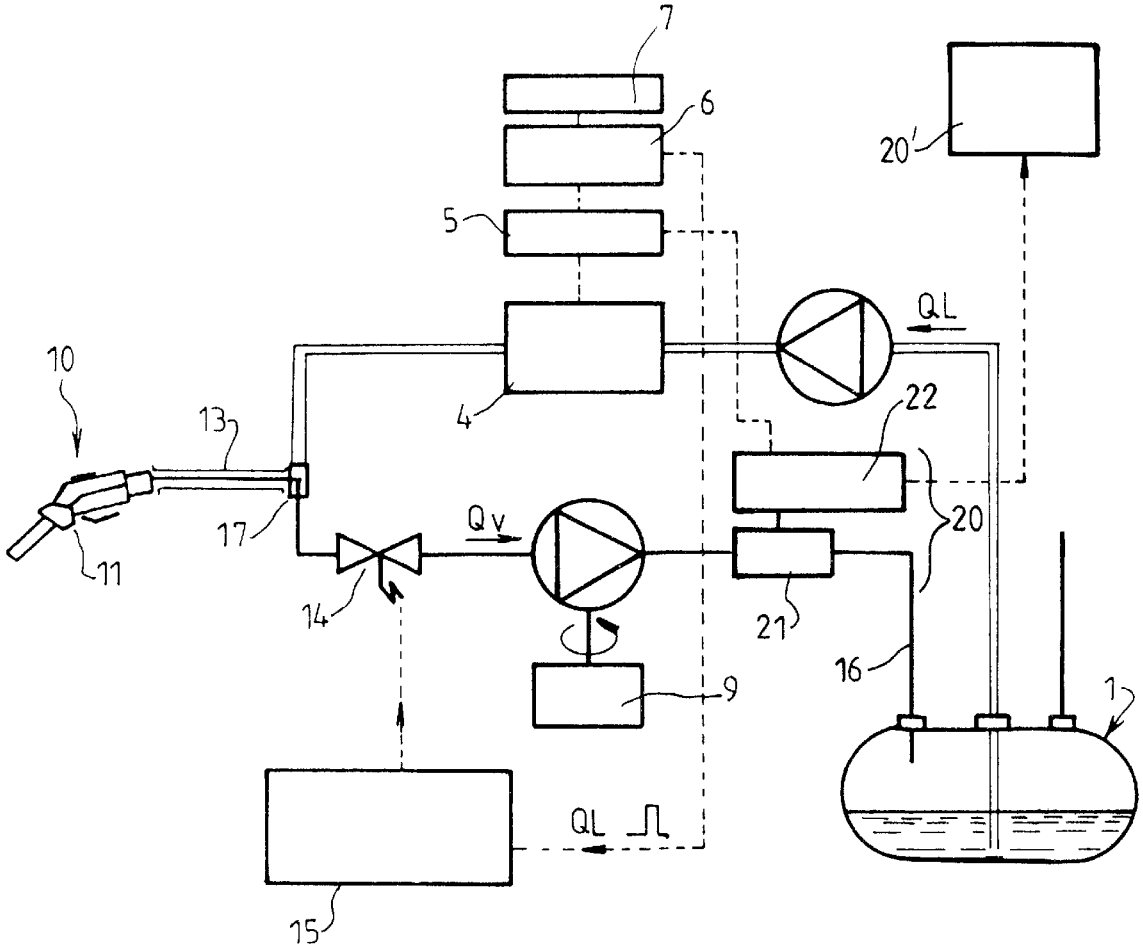
FIG. 2 is an installation corresponding to a first embodiment of the invention.

As may be seen from FIG. 2, the installation illustrated in FIG. 1 is additionally equipped with detection and comparison means 20 comprising a flow meter 21 fitted on the vapour recovery pipe 16 downstream of the recovery pump 8 as well as a flow comparator 22 provided with a microprcessor.

The flow comparator 22 is connected to the pulse coder 5 or, as may be the case, the computer 6 so as to be supplied with an instantaneous value for the liquid delivery rate QL either directly or derived from a computation.

Using this value of the liquid delivery rate QL as well as the value of the vapour delivery rate QV transmitted to it by the flow meter 21, the flow comparator 22 computes; at any instant the QV/QL ratio and, if this ratio moves outside a predetermined range stored in the microprocessor memory (for example 0.9/1.1), it transmits a signal to alarm means 20' enabling an alarm to be triggered drawing attention either to a fault in the vapour recovery system or to failure of the flow meter 21 or flow comparator 22.

Figure 3:
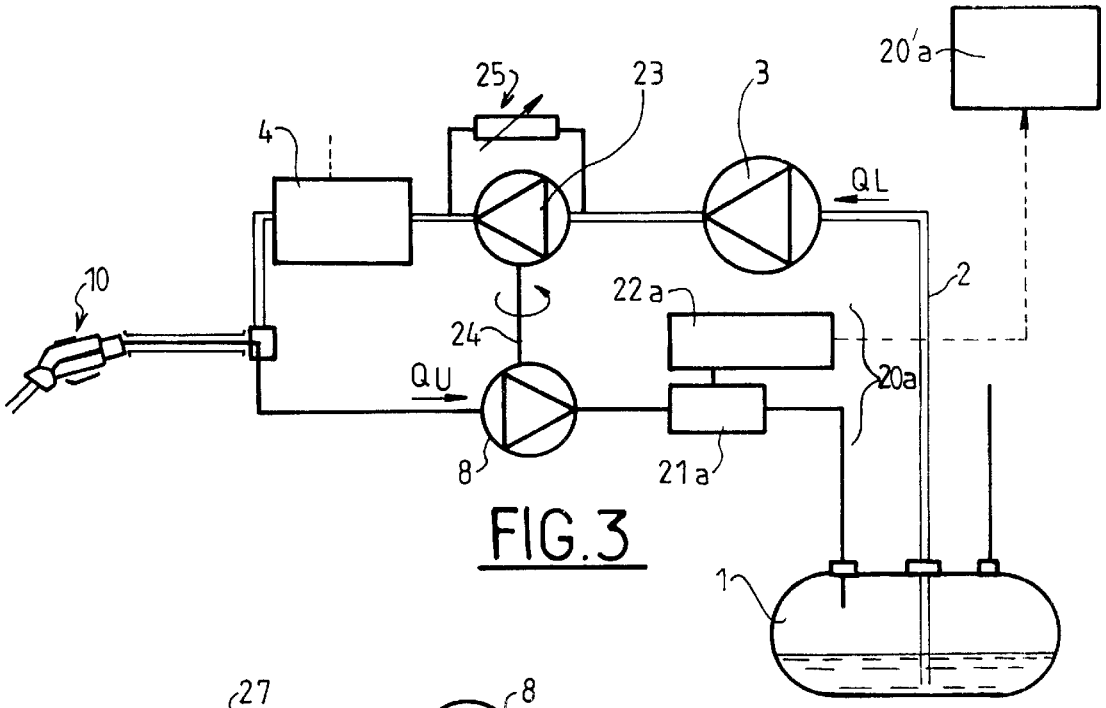
FIG. 3 is a first variant of an installation corresponding to the second embodiment of the invention.

As illustrated in FIG. 3, the fuel dispensing installation does not have an electronic control unit and the recovery pump 8 is driven by a hydraulic motor 23, the rate of which is imparted by the passage of fuel in he dispensing pipe 2, the energy being supplied by the delivery pump 3.

A shaft 24 provides a rigid link between the hydraulic motor 23 and the recovery pump 8, which therefore rotate at the same speed.

The maximum speed of the hydraulic motor 23 corresponds to a vapour delivery rate QV which is greater than the maximum liquid delivery rate QLmax.

This installation is calibrated on the basis of the maximum liquid delivery rate QLmax, In order to bring the vapour delivery rate QV and the liquid delivery rate QL into line, the speed of the hydraulic motor 23 is adjusted by diverting some of the liquid flow QV with the aid of a mechanically controllable hydraulic shunt 25.

Figure 4:
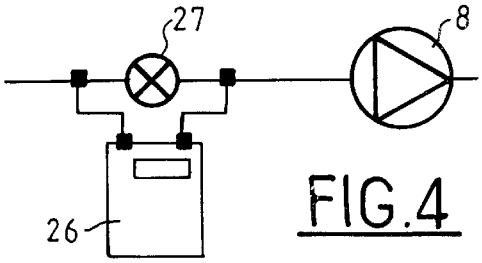
FIG. 4 is a detail from FIG. 3.

As illustrated in FIG. 4, a gas counter or a flow meter 26 co-operating with a check valve 27 inserted in the vapour recovery pipe 16 upstream of the recovery pump 8, fitted during the calibration process, enables the detection and comparison means 20*a* to be controlled. These means are set up by linking a flow meter 21*a* and a flow comparator 22*a* fitted with a mechanical storage system pre-set to the maximum liquid delivery rate QLmax in a manner that will be described in more detail below. Accordingly, a signal can be forwarded to the alarm means 20'*a* which triggers an alarm indicating a malfunction if the ratio QV/QLmax is below an adjustable predetermined threshold.

Figure 5:
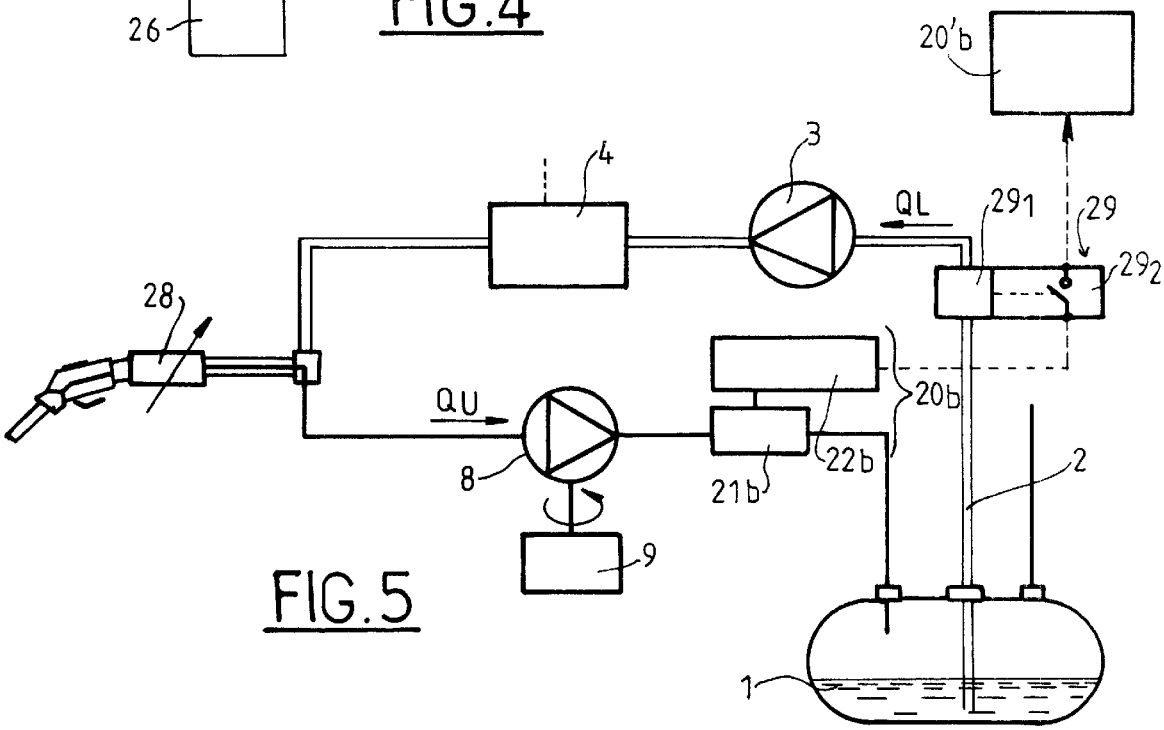
FIG. 5 is a second variant of an installation corresponding to the second embodiment of the invention.

As illustrated in FIG. 5, the recovery pump 8 is driven not by a hydraulic motor such as that 23 illustrated in FIG. 3 but by an independent motor 9 and the installation is initially calibrated on the maximum value of the liquid delivery rate QLmax by a mechanically adjustable pressure reducer 28, which acts on the vapour delivery rate to obtain QV=QL.

In addition, the detection and comparison means 20*b* are established by connecting a flow meter 21*b* to a flow comparator 22*b* co-operating with means for disabling 29 alarm means 20'*b*.

These alarm-disabling means 29 consist of a calibrated liquid flow detector $\mathbf{29}_1$ branching into the liquid dispensing pipe 2 and co-operating with an alarm switch $\mathbf{29}_2$; consequently; the alarm means 20'*b* can therefore be disabled if the liquid delivery rate QL is below a predetermined fraction of its maximum value QLmax.

Figure 6:
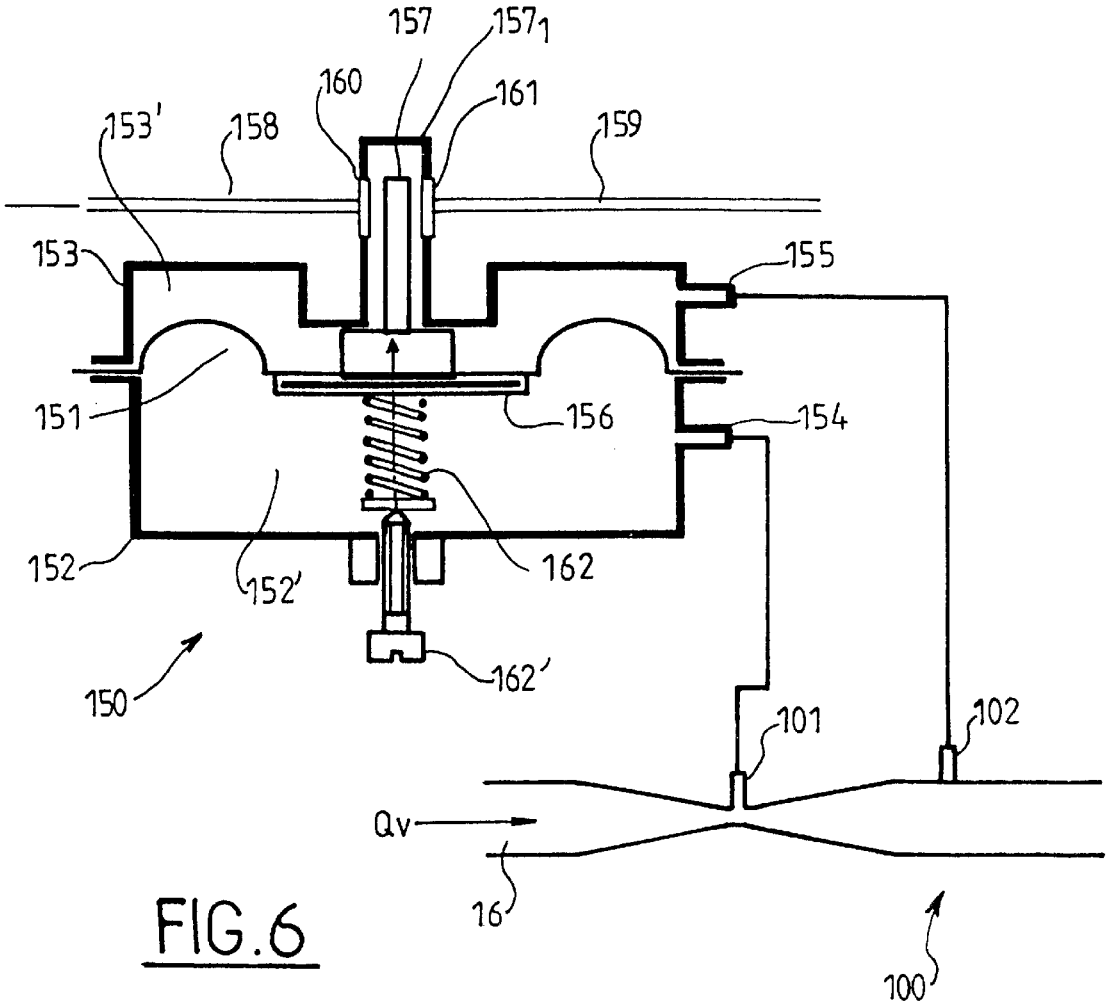
FIG. 6 is an example of detection means and comparison means used with an installation corresponding to the second embodiment of the invention as illustrated in FIGS. 3, 4 and 5, FIGS. 7*a*, 7*b* and 7*c* give an example of the layout of detection means provided in the form of a mechanical oscillator.

As illustrated in FIG. 6, the detection and comparison means are established by connecting a flow detector 100 to a flow comparator 150 having a mechanical memory.

In this embodiment, the flow detector 100 consists of a constrictive member of the Venturi type mounted on the vapour recovery pipe 16 and provided with two pressure taps 101, 102, located respectively on a level with the Venturi neck 100 and on a level with the outlet It is clear that the pressure difference between the taps 101 and 102 will depend on the vapour flow rate QV.

The flow comparator 150, which is an element sensitive to the pressure difference ΔP between the taps 101 and 102, is made up of a membrane 151 with an effective surface S, which is clamped at its periphery between two half-housings 152 and 153, to provide a tight seal.

The half-housings 152 and 153 are respectively provided with pressure taps 154, 155, each being linked to one of the pressure taps 101, 102 of the Venturi 100, The membrane 151 therefore sub-divides the casing comprising the two joined half-housings 152, 153 into two chambers 152', 153'.

The pressure on a level with the neck of the Venturi 100 prevails in chamber 152' which is connected to the pressure tap 101 whilst the pressure on a level with the outlet of the Venturi 100 prevails in chamber 153' which is connected to the pressure tap 102.

Furthermore, the membrane 151 is joined to and bears a plate 156 on which a rod 157 is fixed, extending inside a cylindrical appendage $\mathbf{157}_1$ extending the chamber 153' connected to the pressure tap 102.

The cylindrical appendage $\mathbf{157}_1$ is provided with two windows 160, 161 made from a transparent material positioned respectively facing two optical fibers 158, 159, one of which 158 is linked to a light source whilst the other 159 is linked to a photo-receiver, not illustrated, which is connected to an amplifier allowing the alarm to be triggered, indicating malfunction if the photo-receiver is not receiving any light.

The presence of the rod 157 between the windows 160, 161 prevents the light from being transmitted from the optical fibre 158 to the optical fibre 159, thus triggering the alarm.

Furthermore, the chamber 1521 connected to the pressure tap 101 encloses a spring 162 which is very flexible but compressed across a long length by means of an adjusting screw 162' to allow the plate 156 joined to the membrane 151 to be applied against the walls of the half-housing 153 with a force F when in the position illustrated in FIG. 6, in which the rod 157 obscures the windows 160 and 161.

From this position, when the vapour delivery rate QV increases, the pressure differential ΔP between the taps 101 and 102 also increase until the membrane 151, due to the effect of the pressure prevailing in chamber 153' connected to the pressure tap 102, exerts a force SΔP greater than the force F and opposing the latter At this instant, the membrane 151 is suddenly retracted and the rod 157 exposes the windows 160, 161; light is then able to pass between the optical fibres 158 and 159 towards the photo-receiver.

It should be pointed out that when the installation is calibrated, the flow comparator 150 is calibrated by means of the adjusting screw 162' to allow light to pass through, starting from a threshold value of the ratio between the vapour delivery rate QV and the maximum liquid delivery rate QLmax (for example when QV/QLmax≧0.9).

The system described above affords active safety features because:

- the light is only transmitted during normal operation and the alarm is triggered if the light source is no longer emitting or if the photo-receiver is out of service,
- if the membrane 151 is punctured or cracked, it will not allow light to pass between the optical fibres 158 and 159,
- a connection fault between the pressure taps 101, 154 and 102,155 corresponds to the same effect.

This type of system is therefore, in effect, a system of mechanical memory for the maximum liquid pressure QLmax.

It should be pointed out that optical detection of a malfunction has advantages in terms of safety (hazardous atmosphere) although it would alto be possible to replace the rod 157, in a manner not illustrated in the drawings, with a magnetic element connected to a Hall-effect detector or a "Reed" or pneumatic relay or more simply to set up the rod 157 so that any displacement observable from the exterior corresponds to a change of colour to the observer.

It should also be pointed out that the Venturi 100 illustrated in FIG. 6 is assumed to have an angle of 7°±2° so that the function ΔP=f(QV) is a continuous function.

An angle shift in excess of 14°, for example, would render the phenomenon discontinuous. In practice, at a low delivery rate, the jet leaving the neck 101 of the Venturi 100 may not open out and cling to the walls thereof, which would make it impossible to obtain a pressure differential ΔP between the pressure taps 101 and 102.

Over and above a certain flow rate, the jet might cling to the walls of the Venturi and cause a pressure differential. The rate at which this phenomenon occurs can be adjusted by placing an obstacle in the outlet path of the vapour with an adjustable position.

Adding this feature would make it possible to obtain a trigger threshold based on a fluid-related phenomenon and an inexpensive commercially sold pressure sensor would suffice to trigger the alarm on an "all or nothing basis".

Figure 7C:
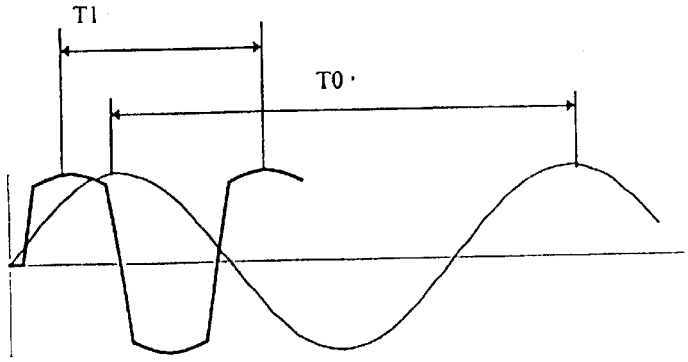
Figure 7A:
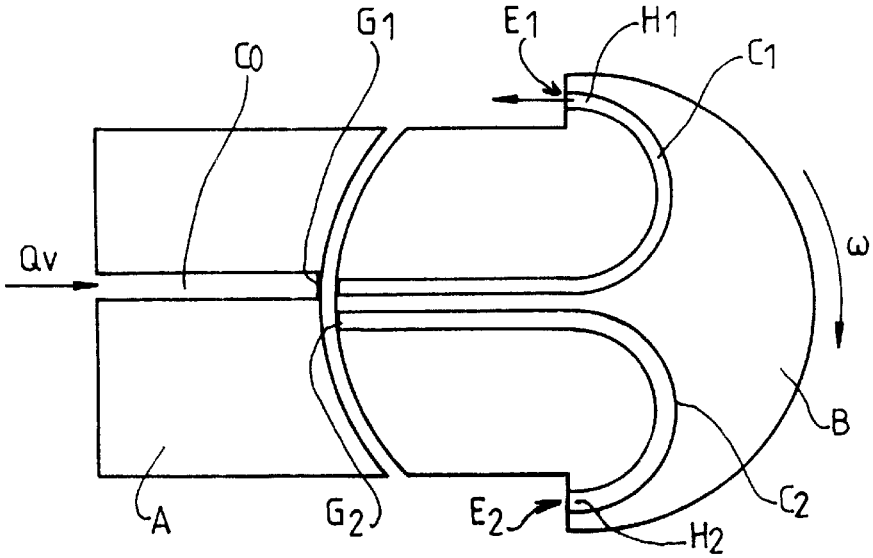
Figure 7B:
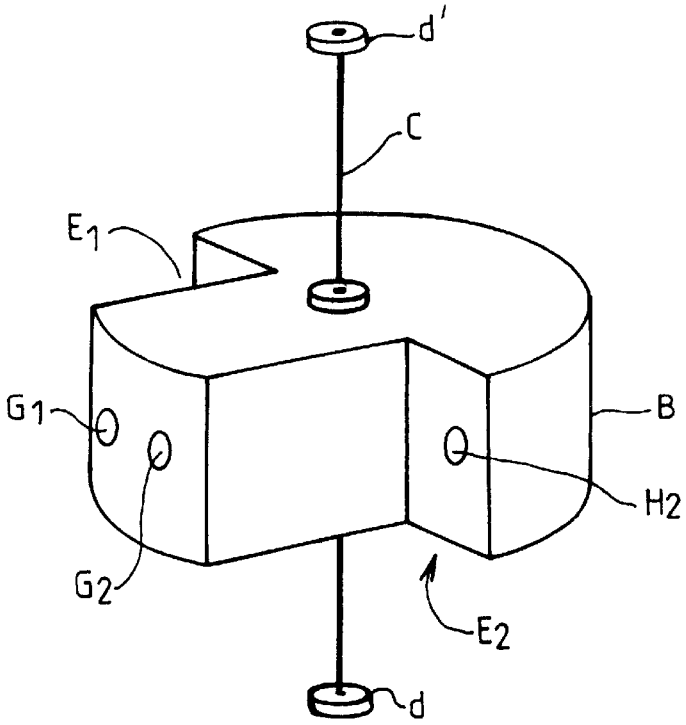

In the example illustrated in FIGS. 7*a*, 7*b* and 7*c*, the detection means consist of an oscillator of the mechanical type.

The oscillator illustrated in FIG. 7*b* consists of a cylindrical disc B one the one hand suspended by a torsion wire C embedded by its ends d and d' and on the other hand having two shoulders E1 and E2.

In FIG. 7*a*, the cylinder B, illustrated in cross section, has two curved passages C1 and C2 bored through it, each hating an inlet orifice G1, G2 and an outlet orifice H1, R2 opening to tho outside on a level with the shoulders E1 and E2.

The passages C1 and C2 each have a straight section adjacent to the inlet orifice G1, G2 as well as a curved section adjacent to the outlet orifice E1, H2

The two straight sections extend substantially parallel in immediate proximity with one another whilst the two curved sections are divergent.

As shown in FIG. 7*a*, the inlet orifices G1, G2 of the passages C1 and C2 of the cylinder B are positioned facing a fixed piece A mounted on the vapour recovery pipe 16 which has an incoming passage C0 for the vapour flow QV.

If the vapour flow QV is zero, the cylinder B is in the non-operating position and the inlet orifice G1 of the passage C1 is located facing the passage C0 of piece A as illustrated in FIG. 7*a*.

When the vapour flow QV starts, the jet entering the passage C1 via the inlet orifice G1 leaves this passage by means of the outlet orifice H1 located on a level with the shoulder E1.

Because of the specific geometry and mounting of the cylinder B, this flow causes it to rotate at an angular velocity ω.

As a result of this rotating notion, the inlet orifice G2 of the passage C2 is displaced in front of the passage C0 of piece A, thereby driving the cylinder B in rotation at a velocity ω in the opposite direction and so on.

An oscillating motion is therefore produced which can be detected by an optical sensor, not illustrated, allowing the alarm to be triggered.

As illustrated in FIG. 7*c*, the angular velocity ω applied to this oscillating system significantly modifies the natural oscillation frequency T0 of piece B producing an oscillation frequency T1 directly related to the vapour flow QV.

Figure 8:
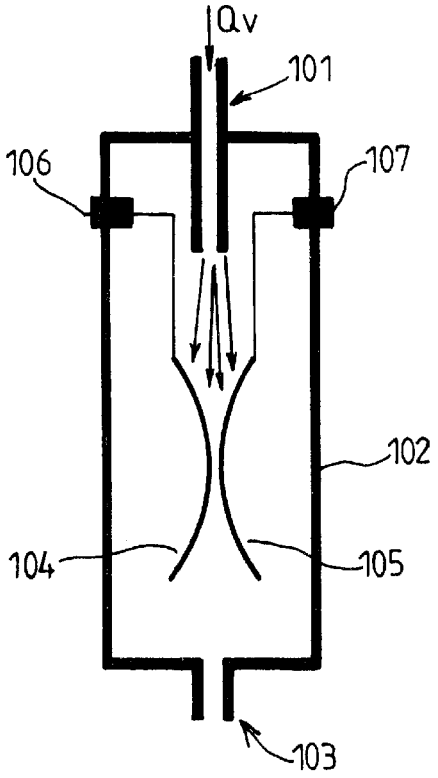
FIGS. 8 and 8*a* illustrate a different operating mode of these detection means.
Figure 8A:
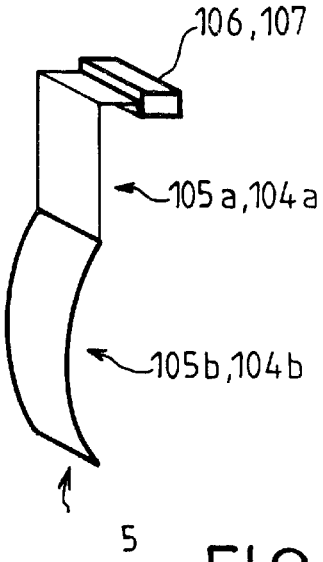

In the example illustrated in FIGS. 8 and 8*a*, the vapour flow QV to be detected is channelled through an end-piece 101 mounted directly on the vapour recovery pipe 16 so that it enters a casing 102 with an outlet orifice 103 as a jet.

In FIG. 8, the median part of the casing 102 is provided with two metal blades 104 and 105 disposed symmetrically and attached to the walls of the casing at points 106 and 107.

In FIG. 8*a*, each of the blades 104, 105 has a flexible part 104*a*, 105*a* close to the points of attachment 106, 107 as well as a thicker part 104*b*, 105*b* of a curved shape which extends freely.

The two curved parts 104*b* and 105*b* form between them a Venturi of sorts.

Because of the design described above, as it passes between the two plates 104, 105, the vapour jet QV causes a drop in pressure compared with the rest of the volume of the casing 102, causing these two plates 104, 105 to be displaced towards one another until they touch one another and locally interrupt the flow QV, which causes the plates to return to their initial position and so on.

Accordingly, an oscillating system is obtained whose frequency depends on the vapour flow QV This frequency may be measured by the interruption caused in a light beam, not illustrated, when the plates 104, 105 come into contact.

Again, this is an active safety feature given that the alternating signal disappears as soon as oscillation is no longer possible or the light beam is interrupted for some accidental reason.

What is claimed is:

1. A liquid dispensing installation of the open loop type, comprising:

a storage tank for the liquid to be dispensed;

a liquid dispensing pipe incorporating a delivery pump enabling the liquid to be pumped from the storage tank to a dispenser gun at a liquid delivery rate QL;

a vapor recovery pipe incorporating a recovery pump enabling the vapor emitted when filling the tank to be pumped from the dispenser gun to the storage tank at a vapor delivery rate QV;

control means enabling the vapor delivery rate QV to be maintained at a level approximately equal to the liquid delivery rate QL, the control of the flow rate QV being only based on an initial calibration of the system at installation;

a detector enabling the flow value QV to be detected constantly;

a comparator sensitive to the vapor delivery rate QV detected by said detector and enabling this value QV to be compared with a value of the liquid delivery rate QL; and alarm means enabling, if the result of this comparison is outside a predetermined range, an alarm to be triggered indicating either a fault in the vapor recovery system or failure of said detector or said comparator.

2. An installation as claimed in claim 1, wherein said detector comprises a flow detector of the fluid-operated oscillator type.

3. An installation as claimed in claim 1, wherein said detector comprises an oscillator of the mechanical type.

4. An installation as claimed in claim 1, wherein said detector comprises a constrictive member connected to a system sensitive to pressure and provided with a mechanical memory.

5. An installation as claimed in claim 1, wherein said detector comprises a restrictive member which does not operate except above a threshold flow rate.

6. An installation as claimed in claim 1, wherein said detector comprises a turbine.

7. An installation as claimed in claim 1, wherein said detector comprises a paddle or an obstacle.

8. An installation according to claim 1, wherein said predetermined range of said comparison is adjustable.

9. An installation according to claim 1, further comprising:

a liquid measuring unit connected into the liquid dispensing pipe;

a pulse generator or coder connected to the liquid measuring unit; and a computer responsive to the output of the pulse generator or coder to establish the volume and price of the liquid dispensed, and to cause them to appear in plain text on a display.

10. An installation as claimed in claim 4, wherein said constrictive member is of the Venturi type.

11. An installation as claimed in claim 5, wherein said constrictive member is of the Venturi type.

12. An installation according to claim 5, wherein said threshold flow rate of said detector is adjustable.

13. A liquid dispensing installation, comprising:

a storage tank for the liquid to be dispensed;

a liquid dispensing pipe incorporating a delivery pump enabling the liquid to be pumped from the storage tank to a dispenser gun at a liquid delivery rate QL;

a vapor recovery pipe incorporating a recovery pump enabling the vapor emitted when filling the tank to be pumped from the dispenser gun to the storage tank at a vapor delivery rate QV;

control means enabling the vapor delivery rate QV to be maintained at a level approximately equal to the liquid delivery rate QL;

a detector enabling the flow value QV to be detected constantly;

a comparator sensitive to the vapor delivery rate QV detected by said detector and enabling this value QV to be compared with a value of the liquid delivery rate QL; and alarm means enabling, if the result of this comparison is outside a predetermined range, an alarm to be triggered, indicating either a fault in the vapor recovery system or failure of said detector or said comparator, and wherein said alarm means cooperates with said detector via optical transmission units.

14. A method of checking the correct operation of an open loop type system for recovering vapor emitted in a liquid dispensing installation, the installation comprising:

a storage tank for the liquid to be dispensed;

a liquid dispensing pipe incorporating a delivery pump enabling the liquid to be pumped from the storage tank to a dispenser gun at a liquid delivery rate QL;

a vapor recovery pipe incorporating a recovery pump enabling the vapor emitted to be pumped from the dispenser gun to the storage tank at a vapor delivery rate QV;

a counter connected into the liquid dispensing pipe and incorporating a liquid measuring unit connected to a pulse generator or coder enabling a computer to establish fie volume of the liquid dispensed; and a controller enabling the vapor delivery rate QV to be maintained at a level approximately equal to the liquid delivery rate QL, the control of the flow rate QV being only based on an initial calibration of the system at the installation, the method comprising the steps of:

constantly detecting the vapor delivery rate QV;

comparing the value of the vapor delivery rate QV thus detected with a value of the liquid delivery rate QL; and triggering an alarm if the result of this comparison is outside a predetermined range, the step of detecting vapor delivery rate QV being carried out by a detector so selected that any failure of said detector will cause the alarm to be triggered, and the step of comparing the value of the vapor delivery rate QV thus detected with a value of the liquid delivery rate QL being carried out by a comparator so selected that any failure of said comparator will cause the alarm to be triggered.

15. A method as claimed in claim 14, further comprising the step of constantly determining said value of the liquid delivery rate QL using said liquid measuring unit and transmitting this value for comparison with the value of vapor delivery rate QV given by flow detection.

16. A method as claimed in claim 14, further comprising the steps of memorizing a preset value for comparison corresponding to the value QV detected during calibration phase at the maximum value QLmax of the liquid delivery rate using said liquid measuring unit.

17. A method according to claim 14, further comprising the step of adjusting said predetermined range of said comparison.

18. A method of dispensing volatile liquid, which comprises:

pumping liquid from a storage tank to and through a dispensing gun at a liquid delivery rate QL;

recovering vapor by pumping from the dispensing gun to the storage tank at a vapor delivery rate QV approximately equal to the liquid delivery rate QL;

continuously detecting the vapor delivery rate QV;

comparing the value of the vapor delivery rate QV thus detected with a value of the liquid delivery rate QL; and triggering an alarm if the result of this comparison is outside a predetermined range.

19. The method of claim 18, further comprising the steps of:

continuously measuring the liquid delivery rate QL;

counting and displaying the volume of the liquid dispensed; and controlling the vapor delivery rate QV to maintain it at said rate approximately equal to the liquid delivery rate QL.

20. A method according to claim 18, wherein the liquid is fuel, comprising the step of dispensing the fuel into the interior of a motor vehicle fuel tank.

21. A method of checking the correct operation of a system for recovering vapor emitted in a liquid dispensing installation, the installation comprising:

a storage tank for the liquid to be dispensed;

a liquid dispensing pipe incorporating a delivery pump enabling the liquid to be pumped from the storage tank to a dispenser gun at a liquid delivery rate QL;

a vapor recovery pipe incorporating a recovery pump enabling the vapor emitted to be pumped from the dispenser gun to the storage tank at a vapor delivery rate QV;

a counter connected into the liquid dispensing pipe and incorporating a liquid measuring unit connected to a pulse generator or coder enabling a computer to establish fire volume of the liquid dispensed; and a controller enabling the vapor delivery rate QV to be maintained at a level approximately equal to the liquid delivery rate QL, the method comprising the steps of:

constantly detecting the vapor delivery rate QV;

comparing te value of the vapor delivery rate QV thus detected with a value of the liquid delivery rate QL;

triggering an alarm if the result of hiss comparison is outside a predetermined range;

disabling the alarm during a predetermined period after activating the liquid delivery pump;

reactivating the alarm during a predetermined time; and disabling the alarm again until the tank-filling operation has finished.

* * * * *

UNITED STATES PATENT AND TRADEMARK OFFICE

CERTIFICATE OF CORRECTION

PATENT NO. : 6,418,981 B1
DATED : July 16, 2002
INVENTOR(S) : Nitecki et al.

It is certified that error appears in the above-identified patent and that said Letters Patent is hereby corrected as shown below:

Title page,
After Item [22], insert the following:
-- [30] Foreign Application Priority Data
Jul. 23, 1999 (FR) ..... 99 09 586
Sep. 8, 1999 (FR) ..... 99 11 212 --

Signed and Sealed this

Twentieth Day of January, 2004

JON W. DUDAS
*Acting Director of the United States Patent and Trademark Office*